US007710050B2

(12) United States Patent
Preston et al.

(10) Patent No.: US 7,710,050 B2
(45) Date of Patent: May 4, 2010

(54) SERIES CONNECTED POWER SUPPLY FOR SEMICONDUCTOR-BASED VEHICLE LIGHTING SYSTEMS

(75) Inventors: Nigel Ashley Preston, Peterborough (CA); Jamie A. MacDonald, Belleville (CA)

(73) Assignee: Magna International Inc, Concord, Ontario (CA)

( * ) Notice: Subject to any disclaimer, the term of this patent is extended or adjusted under 35 U.S.C. 154(b) by 796 days.

(21) Appl. No.: 11/281,332

(22) Filed: Nov. 17, 2005

(65) Prior Publication Data

US 2007/0108843 A1 May 17, 2007

(51) Int. Cl.
*H05B 37/00* (2006.01)

(52) U.S. Cl. ..... 315/312; 315/320; 315/307; 315/291; 315/247; 315/149; 315/158; 315/185 R

(58) Field of Classification Search ..... 315/185 R, 315/185 S, 169.1, 169.3, 200 A, 312, 291, 315/307, 77, 247, 320, 149, 158; 345/44, 345/46, 204, 211–214, 207; 340/815.4, 815.45; 372/29.012, 38.02, 38.04; 362/800
See application file for complete search history.

(56) References Cited

U.S. PATENT DOCUMENTS 6,028,597 A * 2/2000 Ryan et al. ..... 345/211
6,137,816 A * 10/2000 Kinbara ..... 372/29.012
6,239,716 B1 * 5/2001 Pross et al. ..... 340/815.4
7,202,608 B2 * 4/2007 Robinson et al. ..... 315/224
2007/0210722 A1 * 9/2007 Konno et al. ..... 315/185 S

* cited by examiner

*Primary Examiner*—Haissa Philogene
(74) *Attorney, Agent, or Firm*—Clark Hill PLC

(57) ABSTRACT

A novel and advantageous power supply is disclosed for lighting systems employing semiconductor light sources where the semiconductor light sources are connected in series. The power supply includes a constant current source to supply current to the semiconductor light sources and a bypass switch is provided around each semiconductor light source, or each sub-string of series connected semiconductor light sources. By opening or closing respective bypass switches, individual semiconductor light sources or sub-strings of semiconductor light sources can be illuminated or extinguished as desired. If the bypass switches are electrically controllable, such as semiconductor switches or relays, failures of one or more semiconductor light sources can be determined by the power supply and failed light sources can be bypassed and/or redundant semiconductor elements illuminated to replace failed light sources. Further, if the bypass switches are semiconductor switches, the power supply can employ pulse width modulation techniques to dim one or more semiconductor light sources as desired.

18 Claims, 3 Drawing Sheets

SERIES CONNECTED POWER SUPPLY FOR SEMICONDUCTOR-BASED VEHICLE LIGHTING SYSTEMS

FIELD OF THE INVENTION

The present invention relates to power supplies for semiconductor-based vehicle lighting systems. More specifically, the present invention relates to a power supply for powering series connected semiconductor-based lighting systems.

BACKGROUND OF THE INVENTION

Automotive lighting systems are increasingly making use of semiconductor light sources, such as light emitting diodes (LEDs), due to their reliability, power efficiency and the reduced amount of waste heat they produce, compared to incandescent light sources. With improvements in semiconductor devices, it has recently become possible to construct high output lighting systems, such as vehicle headlamp systems, using LED light sources.

However, while semiconductor light sources do offer advantages over other light sources, such as incandescent or gas discharge sources, they also have some weaknesses. In particular, LEDs are susceptible to over-voltages, wherein too much voltage is applied to their semiconductor junctions, resulting in too much current flowing through the semiconductor junctions, damaging the LED and shortening its life. Also, if too little current is supplied, LEDs produce less light (fewer lumens) and the lighting system may not output sufficient lumens to meet safety and/or regulatory requirements.

As automotive electrical systems typically experience relatively wide voltage swings and as automotive lighting systems typically must operate over wide temperature ranges and conditions, it has been difficult to provide appropriate electrical power to semiconductor light sources at a reasonable cost.

In addition to controlling the electrical power supplied to the LEDs, it can also be desirable to turn some LEDs on and some off. For example, a headlamp may have LEDs which are only illuminated when the headlamp is forming a high beam pattern. In prior art systems, a power supply would be provided for each set or group of LEDs to be separately illuminated and, while such a design could provide the desired flexibility, it was also quite expensive.

Also, as the characteristics of the semiconductor junctions in each LED vary, it is difficult to connect LEDs in parallel to the power supply as the parallel connected LED with the lowest junction resistance would receive too much current while the parallel connected LED with the highest junction resistance would receive too little current. Thus parallel connected semiconductor lighting systems are generally avoided. However, series connected semiconductor light sources also suffer from disadvantages in that the failure of a single semiconductor light source (which generally fail as open circuits) results in the failure of the entire series connected string of semiconductor light sources. Further, such series connected power supplies have been unable to provide for the dimming of some LED light sources in a lighting system. Any dimming of an LED in the series would result in every other LED also being dimmed.

It is desired to have a power supply for semiconductor-based automotive lighting systems, particularly high output lighting systems such as headlight systems, which is not subject to these problems.

SUMMARY OF THE INVENTION

It is an object of the present invention to provide a novel power supply for semiconductor light sources which obviates or mitigates at least one disadvantage of the prior art.

According to a first aspect of the present invention, there is provided a power supply for series-connected semiconductor light sources, comprising: a constant current source to supply a pre-selected level of electrical current to the series connected semiconductor light sources; and a bypass switch across each respective one of the semiconductor light sources, each bypass switch operating when closed to provide a current path around a respective semiconductor light source.

Preferably, the constant current source is a buck boost converter. Also preferably, the bypass switches are semiconductor switches and the power supply further includes a controller to operate the semiconductor switches. Also preferably, the controller is operable to pulse width modulate the operation of at least one bypass switch to dim the corresponding semiconductor light source and is further operable to detect failures of semiconductor light sources.

The present invention provides a novel and advantageous power supply for lighting systems employing semiconductor light sources. The semiconductor light sources are connected in series to a constant current source and a bypass switch is provided around each semiconductor light source, or each sub-string of series connected semiconductor light sources. By opening or closing respective bypass switches, individual semiconductor light sources or sub-strings of semiconductor light sources can be illuminated or extinguished as desired. If the bypass switches are electrically controllable, such as semiconductor switches or relays, failures of one or more semiconductor light sources can be determined by the power supply and failed light sources can be bypassed and/or redundant semiconductor elements illuminated to replace failed light sources. Further, if the bypass switches are semiconductor switches, the power supply can employ pulse width modulation techniques to dim one or more semiconductor light sources as desired.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
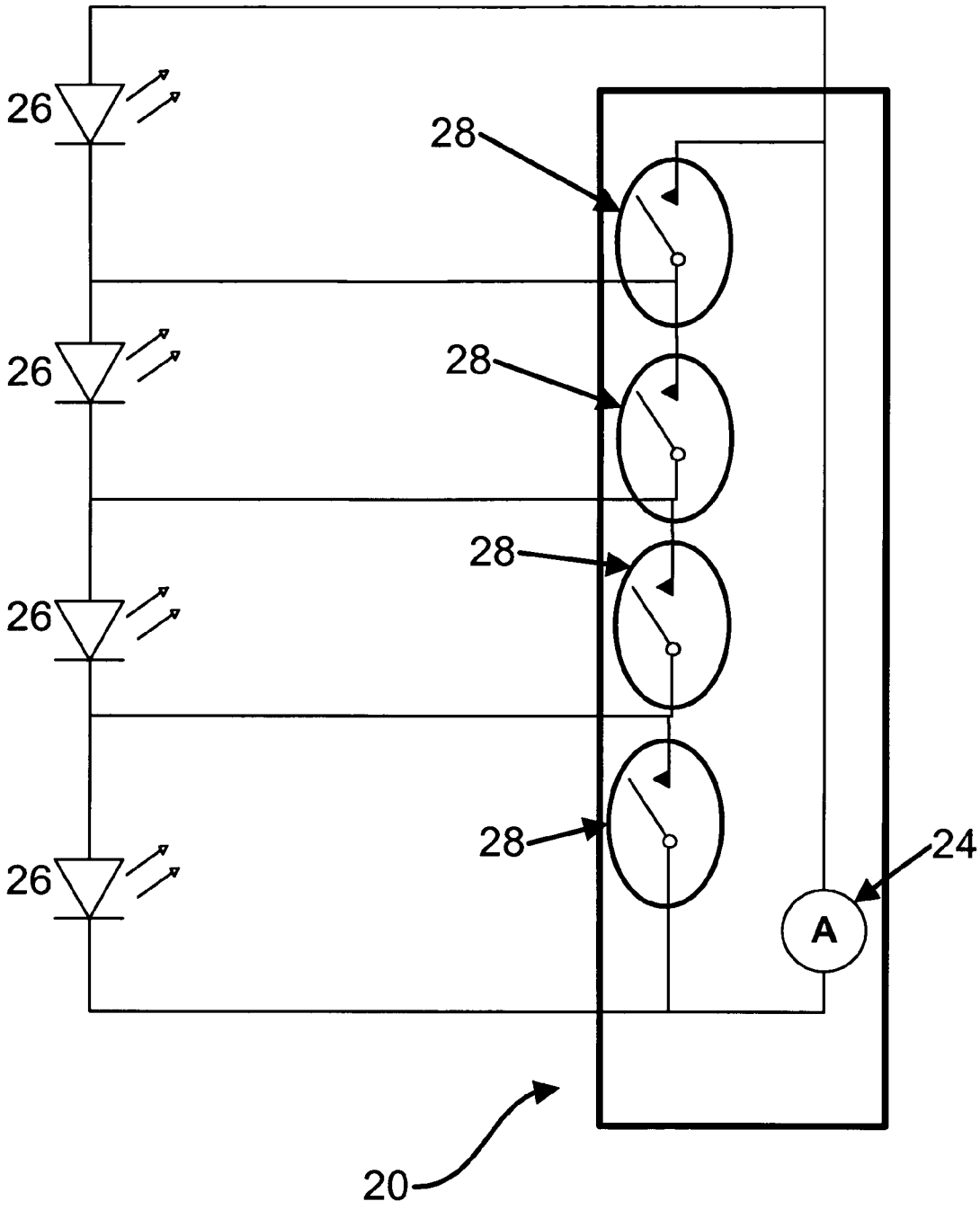
FIG. 1 shows a schematic of a first embodiment of the present invention.

A series switching power supply for powering semiconductor light sources in accordance with the present invention is indicated generally at 20 in FIG. 1. Power supply 20 includes a constant current source 24 which delivers a pre-selected current independent (within its supported current and voltage ranges) of the load of the devices connected between its output terminals. Such constant current sources are well known and a presently preferred example of such a constant current source is a "buck boost" converter. Buck boost converters are well known and are commonly used for DC to DC power conversion and can easily be configured to act as a constant current source. Many other designs can be employed for constant current source 24, including Single Element Primary Inductor Circuit (SEPIC) types.

As illustrated, the output of constant current source 24 is supplied to a series-connected set of semiconductor light sources, in this embodiment LEDs 26. While the illustration shows four LEDs 26 connected in series, as will be apparent to those of skill in the art the present invention is not so limited and more or fewer LEDs 26 can be connected, as desired.

Power supply 20 further includes a bypass switch 28 for each LED 26. When a bypass switch 28 is closed, the current supplied from constant current source 24 bypasses the respective LED 26 to prevent that LED 26 from being illuminated while allowing the other LEDs 26, whose respective bypass switches 28 are open, to still be illuminated.

As will be apparent, LEDs 26 need not be identical devices but should have similar forward current operating levels. In such a case, an appropriate current level is selected to be supplied by constant current source 24 and the selected current level will be provided to each operating LED 26 independent of the number of LEDs 26 which are operating. As bypass switches 28 are switched between open and closed positions, their respective LEDs 26 will correspondingly be illuminated or extinguished and yet each operating LED 26 will always be provided with the selected current level.

If an LED 26 should fail as an open circuit, which is the most common failure mode of an LED, its respective bypass switch 28 can be closed so that the current from constant current source 24 will still be provided to LEDs 26 whose bypass switches are open. Similarly, if it is desired to illuminate some of LEDs 26 and not others of LEDs 26, the respective bypass switches 28 of the LEDs 26 which are to not be illuminated are closed, bypassing those non-illuminated LEDs 26.

The design and/or selection of bypass switches 28 is not particularly limited and can comprise mechanical switches, relays and/or semiconductor switching devices.

Figure 2:
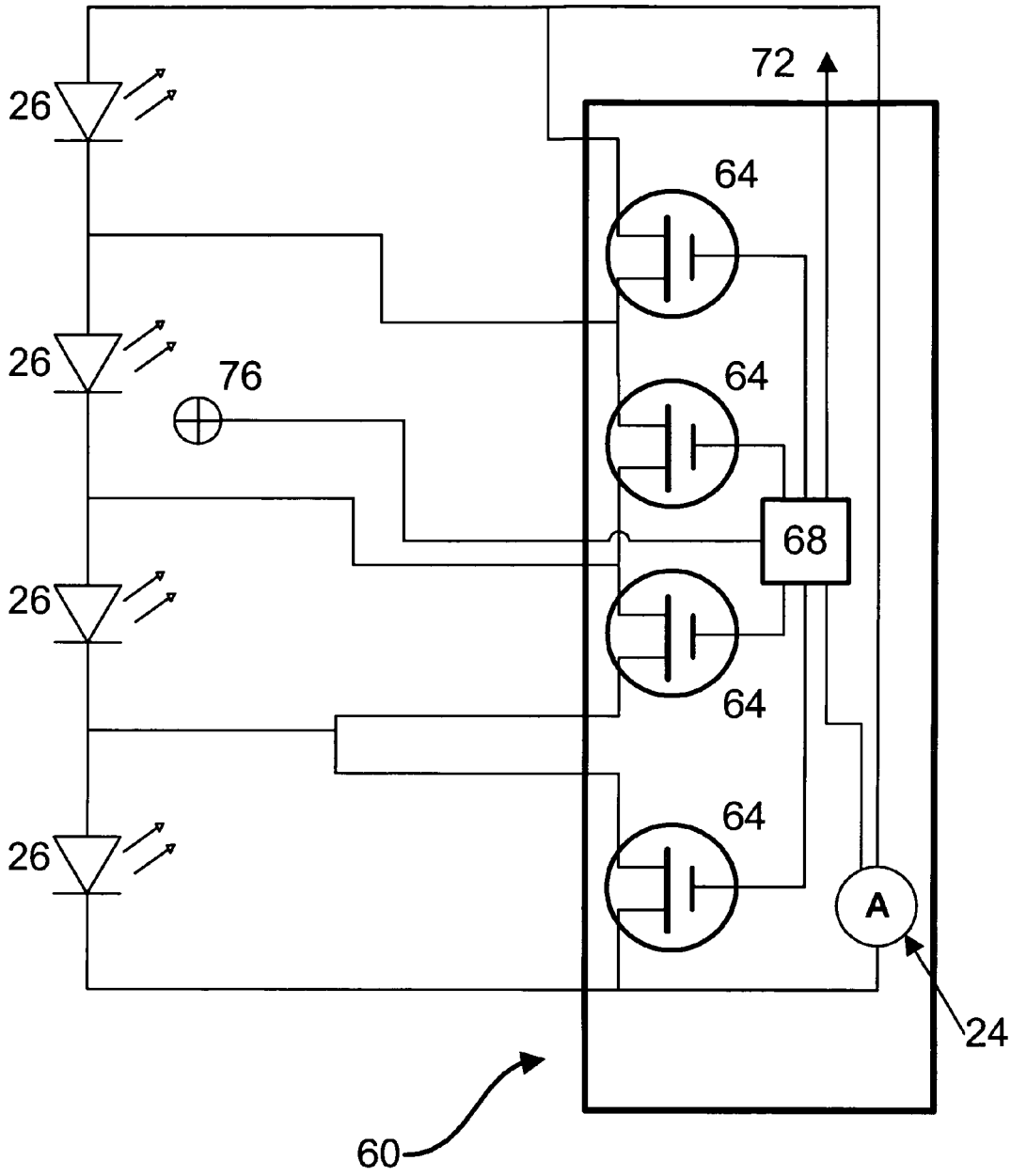
FIG. 2 shows a schematic of a second embodiment of the present invention.

FIG. 2 shows another embodiment of a power supply 60 in accordance with the present invention, wherein like components to those in FIG. 1 are indicated with like reference numerals. In this embodiment, power supply 60 is equipped with bypass switches 64 which are electrically controllable, in this specific implementation MOSFET devices, that are controlled by a controller 68, such as a microprocessor or microcontroller.

Controller 68 can operate bypass switches 64 to bypass one or more LEDs 26 to illuminate or extinguish LEDs 26 as desired. However, in addition to operating bypass switches 64 to bypass LEDs 26, controller 68 can also perform a variety of other control functions on LEDs 26. For example, controller 68 can use pulse width modulation (PWM) on the gate of one or more bypass switches 64 to control the light emitted by the respective LEDs 26, thus dimming one or more of LEDs 26 as desired.

Further, controller 68 can verify correct operation of LEDs 26. If an LED 26 has failed in an open circuit mode, as indicated by no current flow from current source 24, then controller 68 can close each bypass switch 64, in turn, until current flow occurs and the bypass switch 68 whose closing initiated the current flow will correspond to the failed LED 26. Controller 68 can also turn off, or otherwise control, constant current source 24. For example, controller 68 can turn off constant current source 24 when all of bypass switches 28 are closed to save energy.

If an LED 26 has failed in a short circuit mode, which is an uncommon failure mode for LEDs, controller 68 will monitor the change in the voltage across current source 24 as each bypass switch 64 is opened and closed in turn. As an LED 26 will have an expected voltage drop across it, controller 68 can detect an LED 26 which has suffered a short circuit failure by comparing the voltage across current source 24 when the respective bypass switch 64 is open to the voltage across current source 24 when the respective bypass switch 64 is closed. If the voltage does not change by a value approximately equal to the expected voltage drop across LED 26, then controller 68 will determine that the respective LED 26 has failed.

When an open circuit or short circuit failure has been detected, controller 68 can output an appropriate signal 72, indicating that one or more LEDs 26 has failed. Signal 72 can merely indicate that a failure has been determined, or it can indicate which respective LED 26, or LEDs 26, has failed. Signal 72 can be used in a variety of manners, as will be apparent to those of skill in the art, to provide a warning indicator to the operator of a vehicle that the lighting system may not be meeting regulatory requirements or indicating that the lighting system requires servicing and/or signal 72 can be provided to other devices such as other lighting systems which may then operate in another mode to compensate for the failure of the one or more LEDs 26, etc. As will be apparent to those of skill in the art, the make up of signal 72 is not particularly limited and signal 72 can be an analog signal, a digital signal and/or a digital signal compatible with a communication bus used in a vehicle. In this later case, signal 72 can provide comprehensive information onto the bus, including which LED or LEDs 26 have failed, the amount of current being supplied by, and/or the voltage across, constant current source 24, etc.

As is well known to those of skill in the art, the lifetime of a semiconductor light source, such as an LED 26, is dependent upon the temperature of the semiconductor junction with higher temperatures resulting in decreased expected lifetimes. Accordingly, power supply 20 can be further equipped with one or more temperature sensors 76 which operate to provide an input to controller 68 indicating the temperature adjacent at least one LED 26. Controller 68 can respond to the signals from sensors 76 to reduce the current supplied to LEDs 26 to inhibit or reduce damage to the semiconductor junction when high temperatures are detected.

Specifically, controller 68 can be responsive to a sensor 76 to reduce the current supplied from constant current source 24 to all LEDs 26. Alternatively, if two or more sensors 76 are employed with power supply 20, controller 68 can respond to each respective sensor 76 to pulse width modulate the respective bypass switch 64 to the respective LEDs 26 whose temperature is indicated by each respective sensor 76 to independently vary the average current supplied to the respective LEDs 26.

As a power supply in accordance with the present invention can illuminate or extinguish individual LEDs 26 as desired, and as a power supply in accordance with the present invention can detect failures of LEDs 26, another contemplated advantage of the present invention is that redundant LEDs 26 can be provided in a lighting system. These redundant LEDs 26 would not normally be illuminated but would be illuminated by the power supply if a failure of another LED 26 was detected.

It is contemplated that the present invention provides numerous other advantages. Power supplies in accordance with the present invention are generally easier to design than prior art LED power supplies and generally occupy less volume than comparable prior art power supplies, allowing the power supply to be located with the LEDs 26 and other lighting system components in a common housing. By locating the power supply in a common housing with LEDs 26, the length of electrical leads from the power supply to the LEDs 26 is also generally reduced, reducing line losses in those leads and increasing the efficiency of the lighting system.

When used in vehicle lighting systems, such as vehicle headlamp systems, the cost and volumetric size advantages of the present invention are believed to be particularly desirable and the ability to easily detect failed semiconductor light sources and/or to illuminate redundant semiconductor light sources are particularly advantageous, as is the ability to dim semiconductor light sources by pulse width modulating the respective bypass switches.

Figure 3:
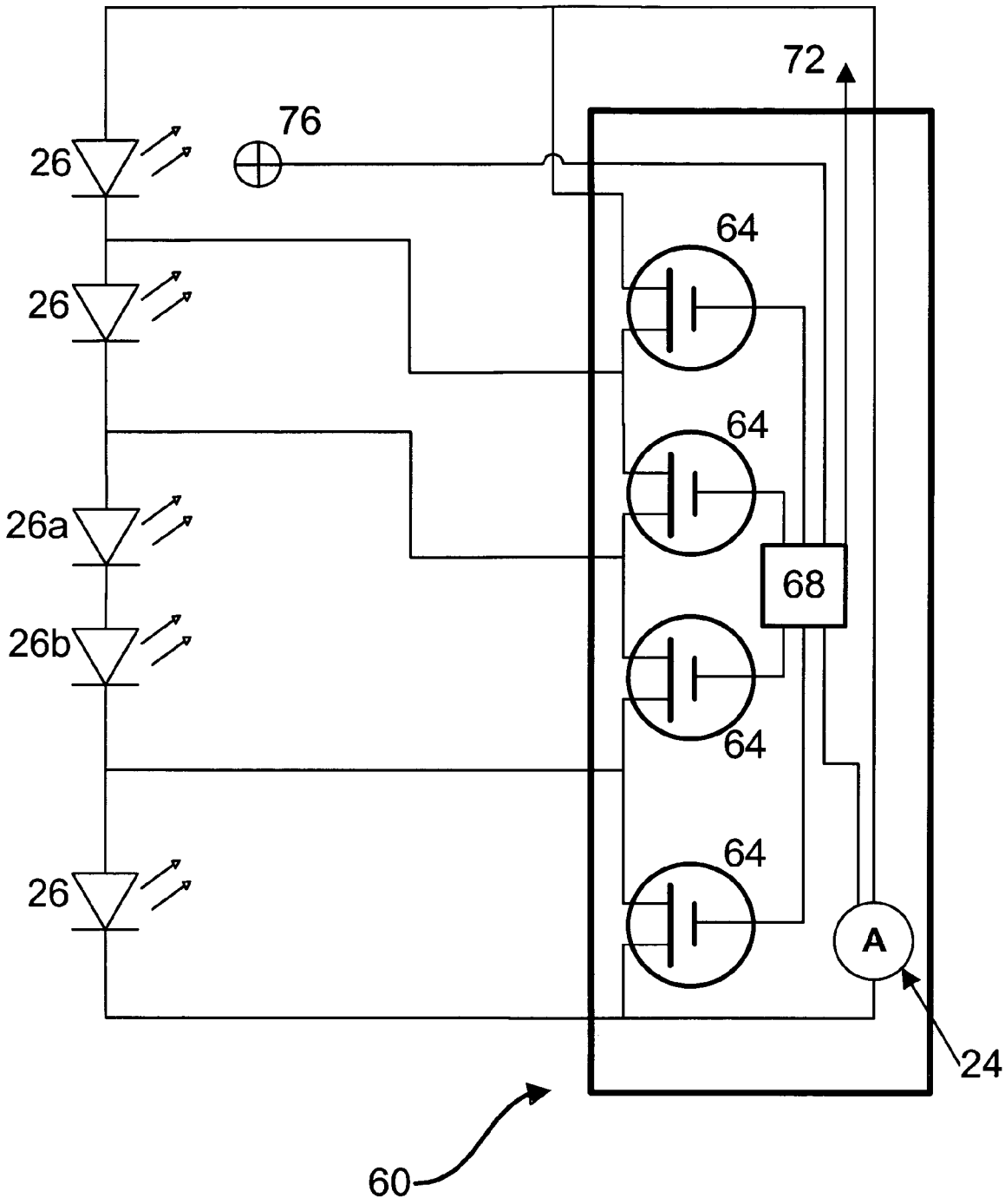
FIG. 3 shows a schematic of another configuration of the embodiment of FIG. 2.

While the description above only discusses having a bypass switch 64 for each LED 26, it is contemplated that in some circumstances two or more series connected LEDs 26*a*, 26*b* can be provided as a sub-string with a single bypass switch 64, as shown in FIG. 3. In such a case each series connected sub-string of LEDs 26 is treated logically as a single LED 26 by controller 68, thus LEDs 26*a*, 26*b* are illuminated or extinguished as a set and a failure of either of LED 26*a* or LED 26*b* is treated as a failure of both LEDs 26*a*, 26*b* by power supply 60.

To detect short circuit failures of one or more of LEDs 26*a*, 26*b* in a sub-string, controller 68 is programmed as to which bypass switches 64 are associated with sub-strings LEDs 26 as the expected voltage drop across a sub-string will generally be larger than the expected voltage drop across a single LED 26. Then, when the above-described voltage drop test is performed, controller 68 monitors for an appropriate voltage level change for single LEDs 26 and an appropriate voltage level change for sub-strings of LEDs (e.g. LED 26*a* and 26*b*).

The present invention provides a novel and advantageous power supply for lighting systems employing semiconductor light sources. The semiconductor light sources are connected in series to a constant current source and a bypass switch is provided around each semiconductor light source, or each sub-string of series connected semiconductor light sources. By opening or closing respective bypass switches, individual semiconductor light sources or sub-strings of semiconductor light sources can be illuminated or extinguished as desired. If the bypass switches are electrically controllable, such as semiconductor switches or relays, failures of one or more semiconductor light sources can be determined by the power supply and failed light sources can be bypassed and/or redundant semiconductor elements illuminated to replace failed light sources. Further, if the bypass switches are semiconductor switches, the power supply can employ pulse width modulation techniques to dim one or more semiconductor light sources as desired.

The above-described embodiments of the invention are intended to be examples of the present invention and alterations and modifications may be effected thereto, by those of skill in the art, without departing from the scope of the invention which is defined solely by the claims appended hereto.

We claim:

1. A power supply for series-connected light emitting diodes in a motor vehicle lighting system, comprising:

a constant current source to supply a pre-selected level of electrical current to the series connected light emitting diodes;

a semiconductor switch across each respective one of the light emitting diodes, each semiconductor switch operating when closed to provide a current path around a respective light emitting diode; and a controller to operate said semiconductor switch, said controller operable to open and close each respective semiconductor switch and further operable to pulse width modulate the operation of at least one semiconductor switch to dim the corresponding light emitting diode.

2. A power supply according to claim 1 wherein the constant current source is a buck boost converter.

3. A power supply according to claim 1 wherein the constant current source is a Single Element Primary Inductor Circuit (SEPIC).

4. A power supply according to claim 1 wherein the controller is further operable to detect failures of light emitting diodes.

5. A power supply according to claim 4 wherein the controller detects closed circuit failures of light emitting diodes by measuring the change in voltage across the constant current source while opening and closing respective semiconductor switches.

6. A power supply according to claim 4 wherein the controller detects open circuit failures of light emitting diodes by measuring the current provided by the power supply.

7. A power supply according to claim 4 wherein the controller detects open circuit failures of light emitting diodes by measuring the voltage provided by the power supply.

8. A power supply according to claim 4 wherein at least one series connected light emitting diode is redundant and its respective semiconductor switch is opened by the controller upon determination by the controller of a failure of another light emitting diode.

9. A power supply according to claim 4 wherein the controller further generates an output signal indicating the detection of a failure of a light emitting diode.

10. A power supply according to claim 9 wherein the output signal indicates which light emitting diode has failed.

11. A power supply according to claim 1 further comprising two or more series connected light emitting diodes arranged as a sub-string of light emitting diodes, the sub-string having a corresponding semiconductor switch across it.

12. A power supply for series-connected light emitting diodes in a motor vehicle lighting system, comprising:

a constant current source to supply a pre-selected level of electrical current to the series connected light emitting diodes;

a bypass switch across each respective one of the light emitting diodes, each bypass switch operating when closed to provide a current path around a respective light emitting diode;

a controller to operate said bypass switches, and at least one temperature sensor providing a signal to said controller to indicate a measured temperature, said controller being responsive to the measured signal to alter the current supplied to at least one light emitting diode.

13. A power supply according to claim 12 wherein the controller is operable to alter the current by pulse width modulating the operation of at least one bypass switch.

14. A power supply according to claim 12 comprising at least two temperature sensors, each respective temperature sensor providing a respective signal to the controller to indicate a respective measured temperature, the controller being responsive to each respective measure signal to alter the current supplied to each respective light emitting diode.

15. A power supply for series-connected semiconductor light sources, comprising:

a constant current source to supply a pre-selected level of electrical current to the series connected semiconductor light sources;

a bypass switch across each respective one of the semiconductor light sources, each bypass switch operating when closed to provide a current path around a respective semiconductor light source; and a controller to operate said bypass switches, said controller operable to detect failures of the semiconductor light sources, wherein said controller detects closed circuit failures of the semiconductor light sources by measuring the change in voltage across the constant current source while opening and closing respective bypass switches.

16. A power supply for series-connected semiconductor light sources, comprising:

a constant current source to supply a pre-selected level of electrical current to the series connected semiconductor light sources;

a bypass switch across each respective one of the semiconductor light sources, each bypass switch operating when closed to provide a current path around a respective semiconductor light source; and a controller to operate said bypass switches, said controller operable to detect failures of the semiconductor light sources, wherein said controller detects open circuit failures of the semiconductor light sources by measuring the current provided by the power supply.

17. A power supply for series-connected semiconductor light sources, comprising:

a constant current source to supply a pre-selected level of electrical current to the series connected semiconductor light sources;

a bypass switch across each respective one of the semiconductor light sources, each bypass switch operating when closed to provide a current path around a respective semiconductor light source; and a controller to operate said bypass switches, said controller operable to detect failures of the semiconductor light sources, wherein said controller detects open circuit failures of the semiconductor light sources by measuring the voltage provided by the power supply.

18. A power supply for series-connected semiconductor light sources, comprising:

a constant current source to supply a pre-selected level of electrical current to the series connected semiconductor light sources;

a bypass switch across each respective one of the semiconductor light sources, each bypass switch operating when closed to provide a current path around a respective semiconductor light source; and a controller to operate said bypass switches, said controller operable to detect failures of the semiconductor light sources;

wherein at least one series connected semiconductor light source is redundant and its respective bypass switch is opened by the controller upon determination by the controller of a failure of another semiconductor light source.

* * * * *